United States Patent [19]

Price et al.

[11] Patent Number: 5,031,781

[45] Date of Patent: Jul. 16, 1991

[54] WALLCOVERING DISPLAY RACK

[75] Inventors: Paul J. Price, Canyon Lake; John D. Hufman, Oakland; Edward D. Edwards, Healdsburg, all of Calif.

[73] Assignee: Dunn-Edwards Corporation, Los Angeles, Calif.

[21] Appl. No.: 495,488

[22] Filed: Mar. 19, 1990

[51] Int. Cl.[5] ..... A47F 7/00

[52] U.S. Cl. ..... 211/45; 211/128; 211/55

[58] Field of Search ..... 211/45, 50, 55, 128, 211/191, 130, 150

[56] References Cited

U.S. PATENT DOCUMENTS

| | | | |
|---|---|---|---|
| 2,707,415 | 5/1955 | Rooney, Jr. | 211/50 X |
| 3,570,679 | 3/1971 | Edson | 211/47 |
| 4,119,207 | 10/1978 | Fuller et al. | 211/45 |
| 4,197,950 | 4/1980 | Ovitz, III | 211/45 X |
| 4,336,888 | 6/1982 | Fuller et al. | 211/45 |
| 4,604,061 | 8/1986 | Willcocks et al. | 211/45 X |
| 4,925,038 | 5/1990 | Gajewski | 211/55 X |

*Primary Examiner*—Carl D. Friedman
*Assistant Examiner*—Sarah A. Lechok
*Attorney, Agent, or Firm*—Stetina and Brunda

[57] ABSTRACT

A modular wallcovering display rack for providing a convenient and cost effective means of displaying wallpaper samples and the like to potential customers is disclosed. The wallcovering display rack is fabricated in modular form so that it may adapted to fit various store configurations and is also easily expandable. The wallcovering display rack comprises a plurality of vertically stacked, inclined shelves upon which individual sheets of wallcovering samples may be placed for display. Vertical columns support the shelves and house fluorescent lights which provide a soft, even illumination of the wallcovering samples. An individual wallcovering sample can be easily removed from the wallcovering rack for closer inspection. The ease of removal also facilitates rapid sample changes to reflect updates in inventory. Each vertical support column has an array of pockets positioned in alignment with and adjacent the stack of shelves. Each pocket may contain a plurality of wallcovering take-home samples of the type displayed in the adjacent shelf. A customer may remove and keep a take-home sample from the pocket for use in deciding upon a particular wallcovering.

12 Claims, 4 Drawing Sheets

Fig. 3
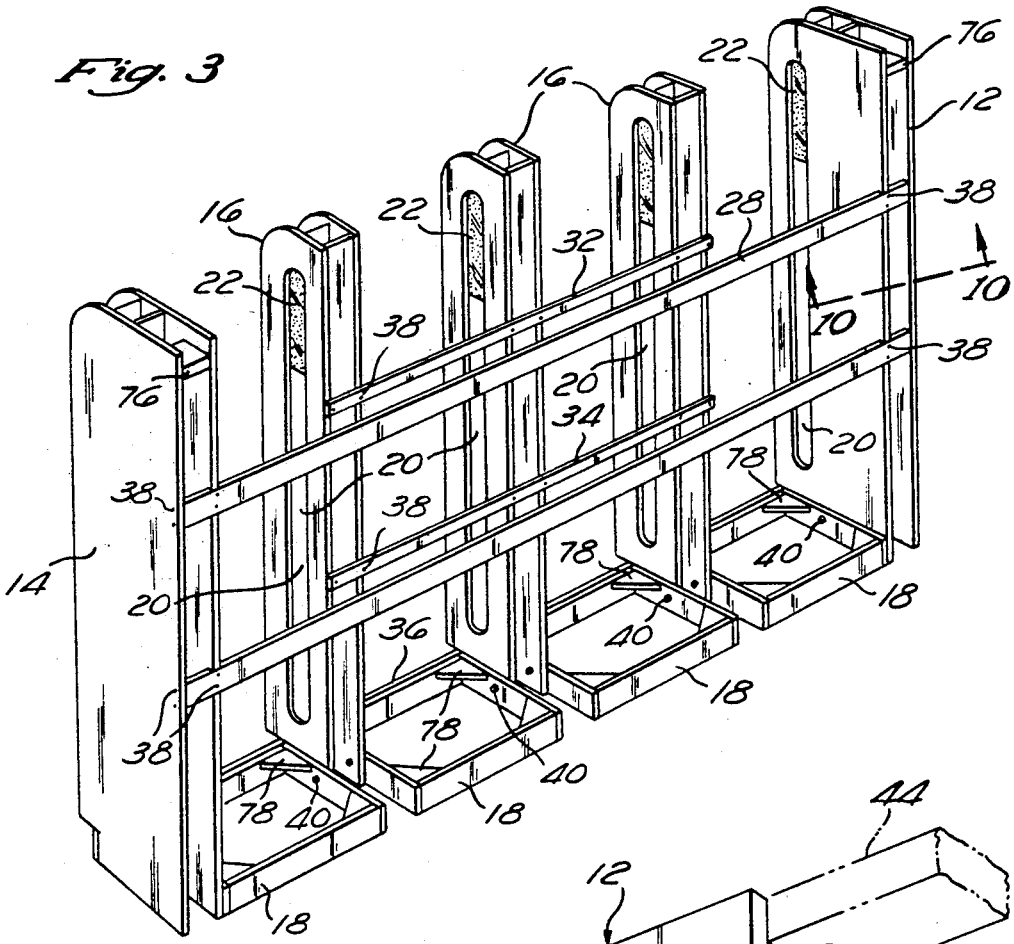
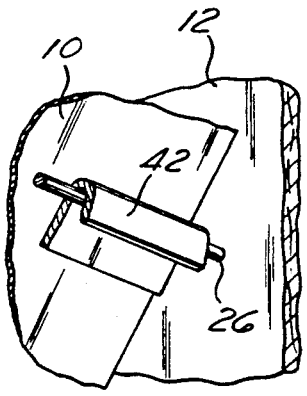
Fig. 11
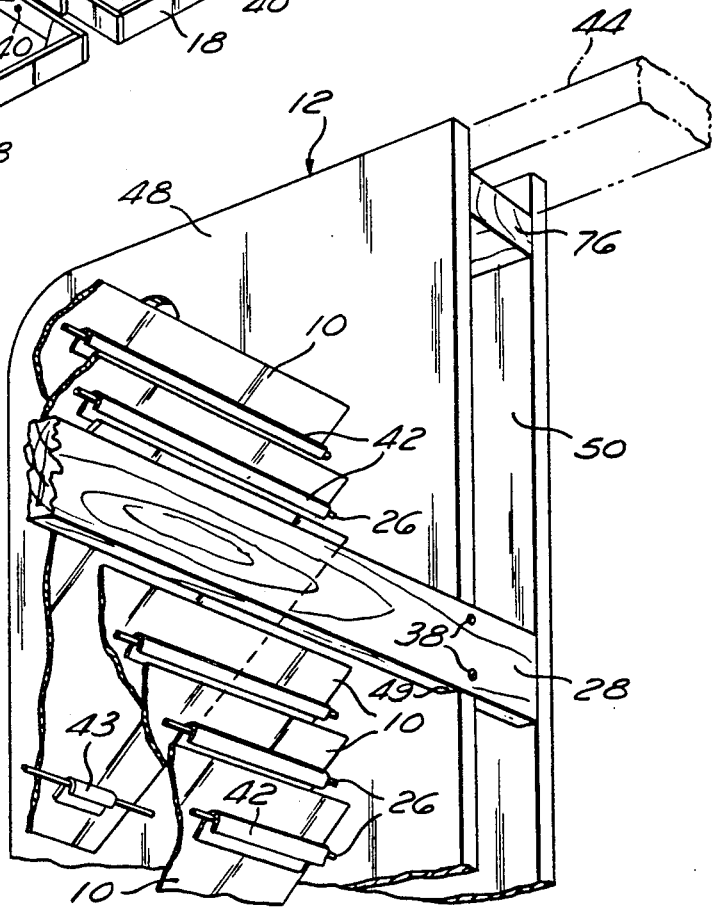
Fig. 10

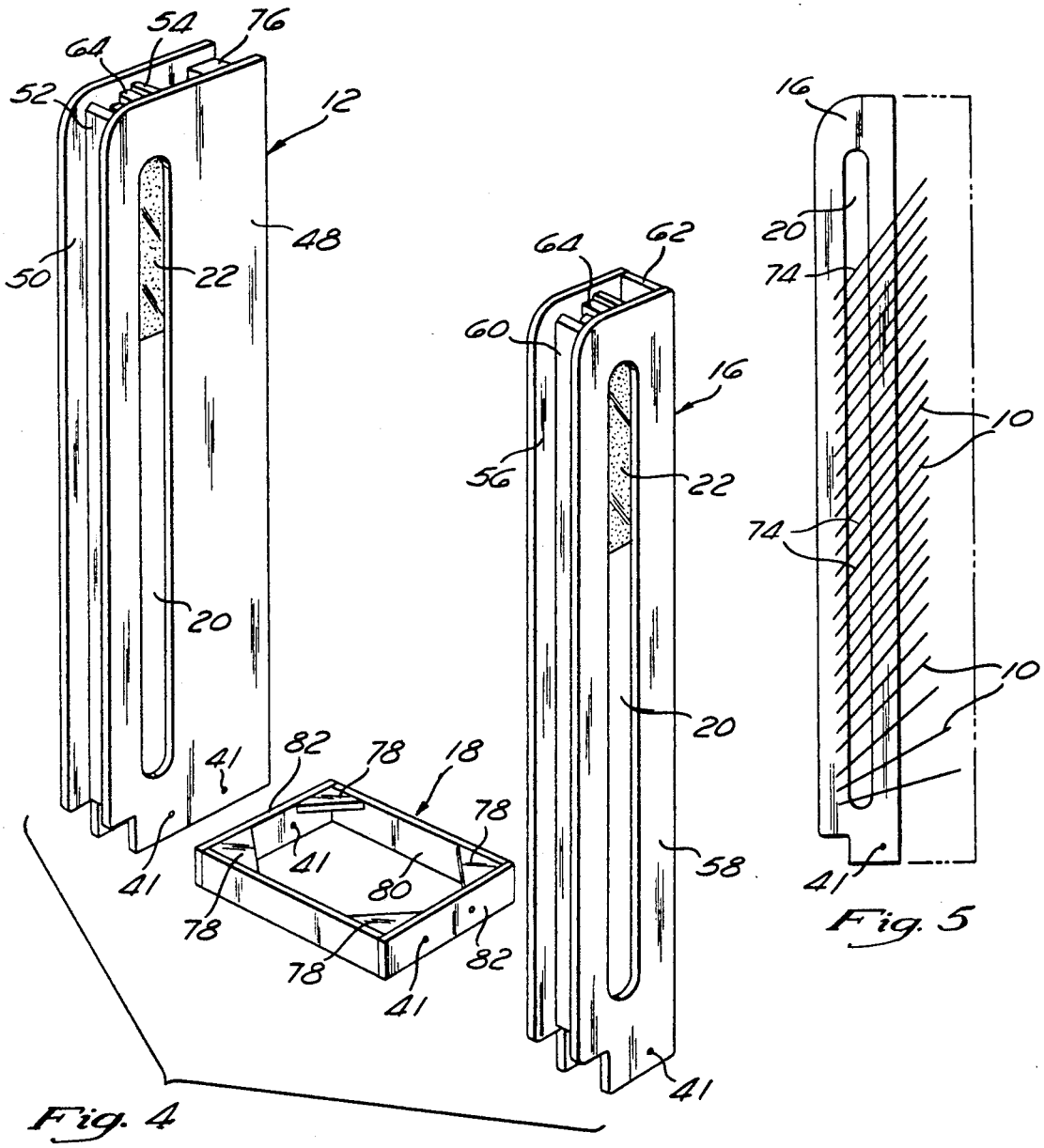
Fig. 4
Fig. 5
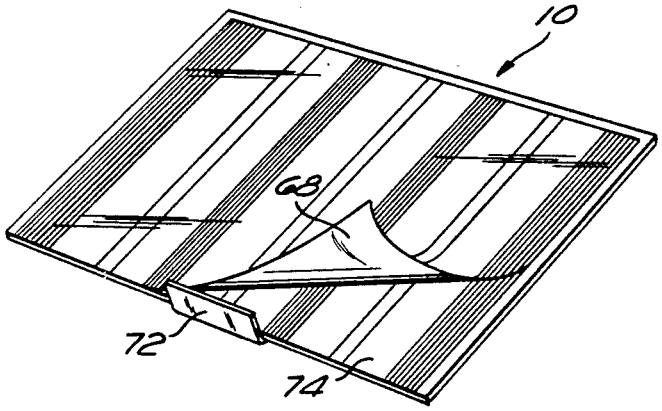
Fig. 6

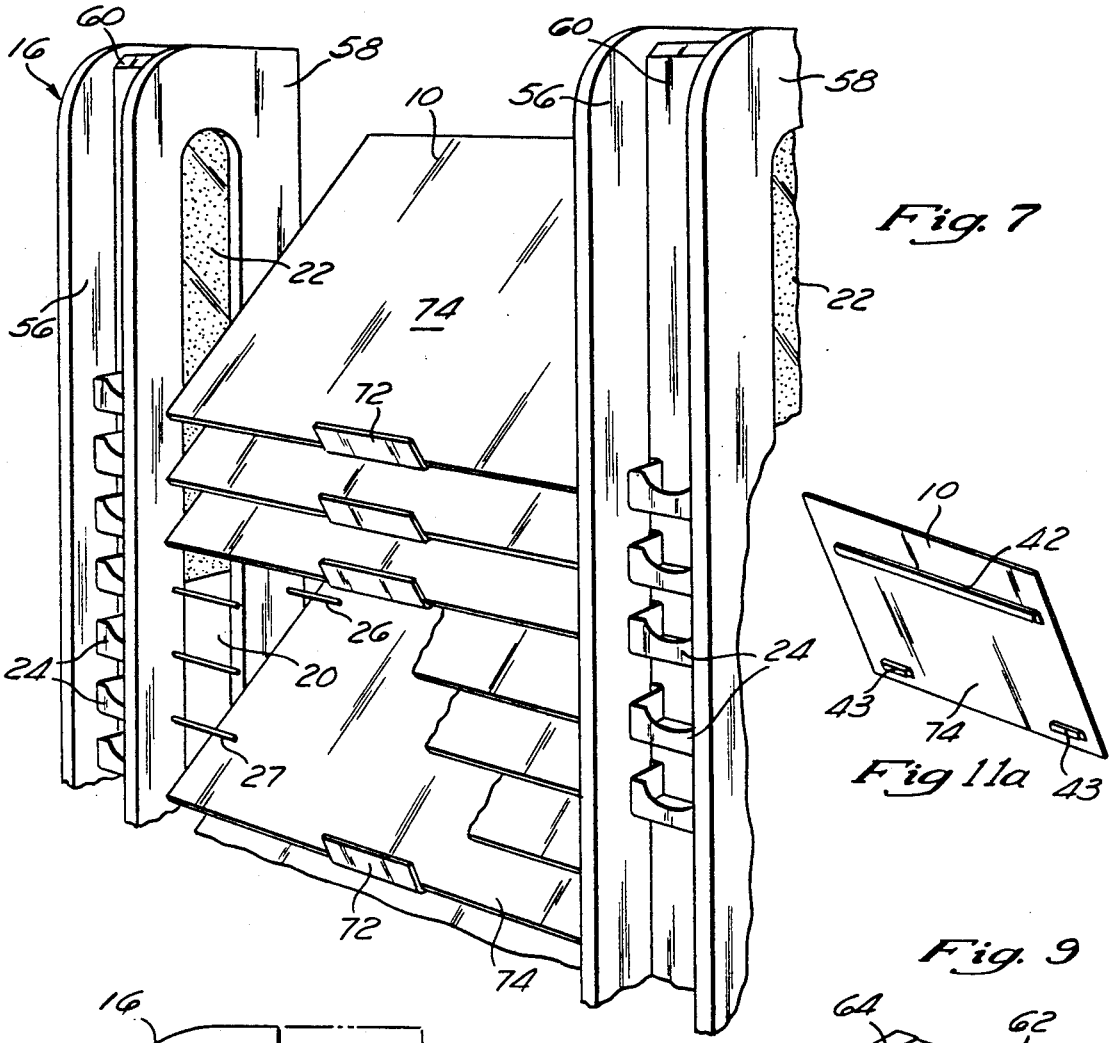
Fig. 7
Fig 11a
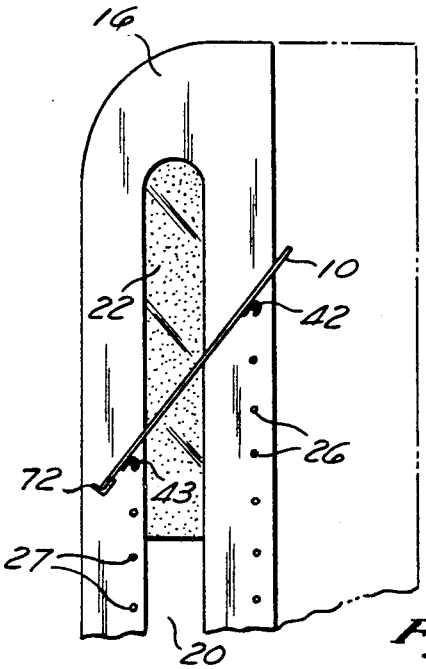
Fig. 8
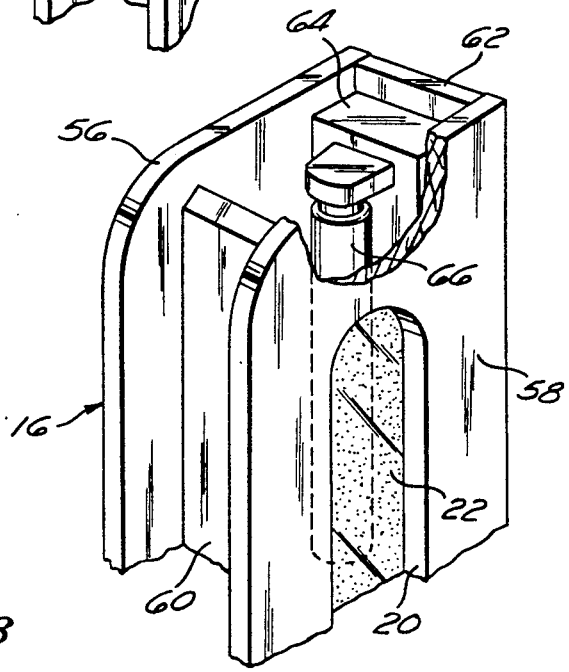
Fig. 9

WALLCOVERING DISPLAY RACK

FIELD OF THE INVENTION

The present invention relates generally to retail display devices and more particularly to a modular wallcovering display rack for providing a convenient and cost effective means of displaying wallpaper samples and the like to potential customers.

BACKGROUND OF THE INVENTION

As is well known, wallcoverings, such as wallpaper, are typically marketed to customers via sample books which comprise a collection of various samples of wallcoverings from a particular manufacturer. By manually paging through such sample books a customer/purchaser is given an opportunity to choose a particular wallcovering according to the customer's own tastes and desires. Although such sample books have proven generally suitable for their intended purpose, they possess inherent deficiencies which detract from their overall effectiveness in the marketplace.

In this regard, the use of such prior art sample books limits the number of wallcoverings that can be displayed at any given time to essentially the one wallcovering visible on the open page of the sample book. As such, the customer must view the samples essentially one at a time by manually turning pages within the prior art wallcovering sample book. This makes comparisons difficult and is an extreme inconvenience when attempting to decide between several different wallcoverings.

The use of such prior art wallcovering sample books also limits viewing of the samples essentially to a single customer. It is virtually impossible for several customers having different wallcovering needs to utilize a single sample book simultaneously.

Further, the prior art wallcovering sample books are typically heavy and awkward to manipulate. This is a problem since it is often desirable to carry one or more sample books to a different location in order to observe particular samples under specific lighting conditions or next to another sample or object. Also, the size and weight of the sample book makes moving the same extremely inconvenient and may require the aid of a sales person.

In addition, frequently the customer desires to take a sample of a wallcovering off premises so that the sample may be viewed in the environment in which it is to be used in order to judge the aesthetic compatibility of the sample to its environment. This entails transporting the sample book from the retail outlet to the location where a new wallcovering is desired. Removal of the sample book from the retail outlet reduces that outlet's marketing effectiveness and incurs the risk that the sample book may be damaged or not returned.

As such, although the prior art sample book has recognized to a limited extent the problem of providing customers with a means of viewing various wallcovering samples and the problem of providing a means of viewing a desired wallcovering sample in the environment in which it is to be used, the proposed solutions have to date been ineffective in providing a satisfactory remedy.

SUMMARY OF THE INVENTION

The present invention specifically addresses and alleviates the above-mentioned deficiencies associated in the prior art. More particularly, the present invention comprises a modular wallcovering display rack for providing a convenient and cost effective means of displaying wallcovering samples and the like to potential customers. The wallcovering display rack is fabricated in modular form so that it may be adapted to fit various store configurations and is also easily expandable.

The wallcovering display rack comprises a plurality of vertically stacked, inclined shelves upon which individual sheets of wallcovering samples may be placed for display. Vertical columns support the shelves and house fluorescent lights which provide a soft, even illumination of the wallcovering samples. An individual Wallcovering sample can be easily removed from the wallcovering rack for closer inspection. The ease of removal also facilitates rapid sample changes to reflect updates in inventory and changes in fashion and design taste.

Each vertical support column has an array of pockets positioned in alignment with and adjacent to the stack of shelves. Each pocket may contain a plurality of wallcovering samples of the type displayed in the adjacent shelf. A customer may thus remove and keep a sample from the pocket for use in deciding upon a particular wallcovering.

Use of the wallcovering display rack of the present invention facilitates segregation of wallcoverings according to both type and color, thereby making it easier for the customer to quickly find the desired wallcovering. For example, each individual vertical stack or module of sample wallcoverings may contain a separate type of wallcovering. One stack could contain floral patterns while another could contain striped patterns. Colors could then be distributed throughout each stack such that all reds, for instance, are at the upper-most end of the stack and all blues are at the lower-most end of each stack, with various other colors arranged similarly therebetween.

Thus, a customer approaching the wallcovering display rack may almost instantly recognize the desired type of wallpaper and may quickly scan down that column of shelves to locate the desired color.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 3 is a perspective view of the rear of the wallcovering displaY rack of FIG. 2;

FIG. 4 is an exploded view of two columns and a base of a single module of the wallcovering display rack of the present invention;

FIG. 5 is a plan side view of a vertical support column showing the relative positions and orientations of the shelves;

FIG. 6 is a perspective view of the upper surface of a single shelf;

FIG. 7 is an enlarged perspective view of a portion of a single module showing the shelf support posts and the sample pockets formed on each column;

FIG. 8 is an enlarged side view showing a single shelf resting upon two shelf support posts which extend from a vertical support column;

FIG. 9 is an enlarged sectional perspective view of a vertical support column showing a fluorescent light and fixture housed therein;

FIG. 10 is an enlarged sectional view taken along lines 10—10 of FIG. 3 of several shelves within a stack showing the attachment of the shelves to the vertical support member using attachment hooks and shelf posts;

FIG. 11 is an enlarged sectional view of a single shelf and a shelf support post showing the attachment hook by which the shelf is attached to the shelf posts; and FIG. 11*a* is a rear perspective view of a single shelf showing the hooks by which the shelf is attached to the posts.

DETAILED DESCRIPTION OF THE PREFERRED EMBODIMENT

The wallcovering display rack of the present invention is illustrated in FIGS. 1–11*a* which depict a presently preferred embodiment of the invention.

Figure 1:
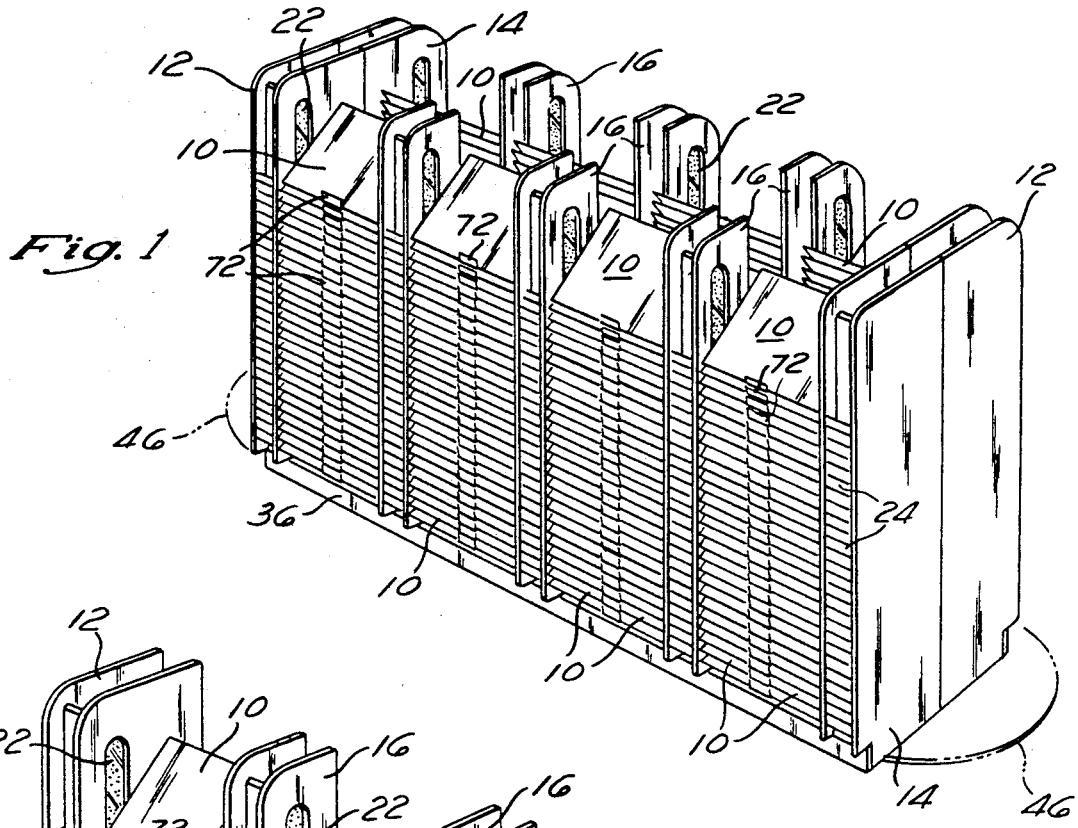
FIG. 1 is a perspective view of the wallcovering display rack of the present invention.

Referring to FIG. 1, plural shelves 10 are stacked vertically and spaced sufficiently from one another to permit the easy insertion and viewing of a sheet of wallcovering samples. The shelves 10 are angularly inclined such that a person standing before them may easily view the outer-most edge of each wallcovering sample. The wallcovering display rack is comprised of a plurality of such modules or stacks of shelves 10 separated by intermediate support columns 16 and terminated on either end by first 12 and second 14 end support columns.

Two such arrays of shelves may be placed back to back as depicted in FIG. 1 to form a single display rack. Base trim 36 may be added to secure the individual modules together and to enhance the wallcovering display rack's aesthetic appeal. An optional semi-circular base member 46, shown in phantom, can also be added to help secure the front display rack to the rear display rack and to further enhance the aesthetic appeal of the display racks.

The wallcovering display rack of the preferred embodiment can be constructed using wood products, such as plywood, lumber, particle board, or the like. The use of wood products permits the simple and inexpensive manufacture and assembly of the wallcovering display rack of the present invention. Those skilled in the art will recognize, however, that other materials, such as plastics or glass, and conventional methods of manufacture are also suitable.

Figure 2:
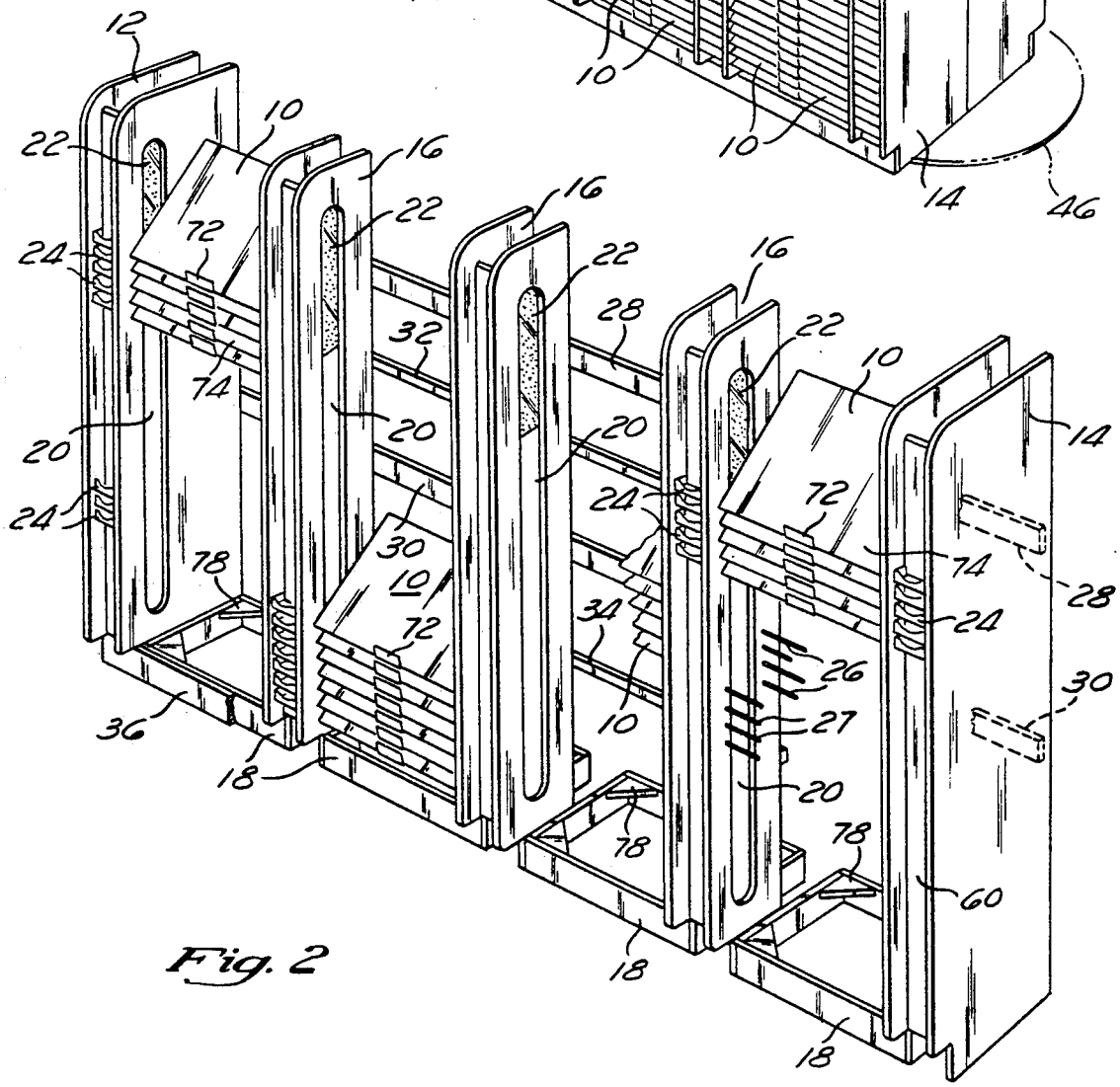
FIG. 2 is a perspective view of one side of the wallcovering display rack of FIG. 1 having shelves removed to show the important features of the rack.

Referring now to FIGS. 2 and 3, light apertures 20 provide an opening through which a fluorescent lamp disposed within each of the support columns 12, 14, and 16, may illuminate the wallcovering samples disposed upon each shelf, thereby facilitating their proper display. A light filter/diffuser 22 disposed at the upper-most end of each light opening 20 diffuses the intensity of the light falling upon the upper-most shelf 10 and provides a pleasing aesthetic effect.

Pockets 24, formed upon each of the support columns 12, 14, and 16, allow small take-home samples of each of the wallcoverings to be disposed adjacent the shelf displaying that wallcovering. These small take-home samples of wallcovering may be removed by the customer and kept in order to help the customer decide upon which wallcovering to purchase.

Bases 18 space the lower-most shelf 10 a few inches off of the floor to permit better viewing and to provide easier access. Gussets 78 strengthen the corners of bases 18 and provide rigidity thereto. Fasteners, such as bolts 40, attach bases 18 to intermediate support columns 16 and end support columns 12 and 14. The base trim 36 is attached to the bases 18, thus concealing the bases 18 from view.

First 28 and second 30 long horizontal members rigidly connect first 12 and second 14 end support columns. Fasteners, such as screws 38, are used to attach first 28 and second 30 long horizontal members to the first 12 and second 14 end support columns.

First 32 and second 34 short horizontal members rigidly connect intermediate support columns 16. Fasteners, such as screws 38, may be used to attach first 32 and second 34 short horizontal members to the intermediate support columns 16. The desired number of modules or stacks of shelves 10 can thus be connected together to form a composite wallcovering display rack of the desired length.

Referring now to FIG. 4, an exploded view of an end support column 12, a base 18, and an intermediate support column 16 is presented. The end support column 12 is comprises of inside panel 48, outside panel 50, front vertical member 52, and spacer 76. The inside panel 48, outside panel 50, front vertical member 52, and spacer 76 are assembled using suitable fasteners, such as wood screws. End support column 14 is constructed in a similar manner. Spacers 76 add rigidity to end support columns 12 and 14 and maintain the proper spacing of panels 48 and 50.

A fluorescent lamp fixture 64 is disposed within each end support column 12 and 14. The fluorescent lamp illuminates the displayed wallcovering samples through light opening 20. Filter/diffuser 22 extends from the upper-most end of light opening 20 a distance downwards such that it terminates below the upper-most shelf 10 in each module. Filter/diffuser 22 diffuses the intensity of the light cast upon the upper-most shelf 10 and also provides a pleasing aesthetic effect. The intensity of the light cast upon the upper-most shelf 10 is reduced due to the larger surface area of the light opening 20 disposed above the top shelf 10.

Each intermediate support column 16 is comprises of first 56 and second 58 side panels, front vertical member 60, and rear vertical member 62. The first 56 and second 58 side panels, front vertical member 60, and rear vertical member 62 are attached using suitable fasteners, such as wood screws. A fluorescent light fixture 64 is disposed within each intermediate support column 16 in a like manner to that of each end support column 12 and 14. Each intermediate support column 16 also has a light opening 20 on either side and a filter 22 disposed in the upper-most portion of each light opening 20.

A quadrilateral base 18 is comprises of longitudinal members 80 and lateral members 82. The intersection of each longitudinal 80 and lateral 82 member is reinforced by a gusset 78. Bolt holes 41 accept bolts which attach the base 18 to end support columns 12 and 14 or to intermediate support columns 16.

Referring now to FIG. 5, a side view of an intermediate support column 16 showing the relative placements and orientations of the shelves 10 is illustrated. The shelves 10 disposed at the lower-most portion of the stack are inclined somewhat less than the shelves 10 disposed in the middle and upper-most portions of the stack. This facilitates the convenient viewing of the lower-most shelves 10 by customers. The outline of an end support column 12 or 14 is depicted in phantom to provide a comparison to the intermediate support columns 16.

Referring now to FIG. 6, a single shelf 10 is illustrated. Each shelf 10 is comprised of a planar member 74 and a stop 72 formed perpendicular to the planar member 74 and disposed along the front edge of the planar member 74. The stop 72 prevents a sample wall covering sheet from sliding downward off of the inclined shelf 10.

As best shown in FIG. 11, each shelf 10 further comprises a rear hook 42 and front hooks 43. Rear hook 42 engages posts 26 disposed upon end support columns 12 and 14 and intermediate support columns 16. Front hooks 43 secure the front of each shelf 10 to front posts 27. This prevents the front of the shelf 10 from being bumped upwards when a lower shelf is being removed or installed. The rear hook 42 and the front hooks 43 secure the shelf 10 in place within the wallcovering display rack and also permit the shelf 10 to be easily repositioned, cleaned, or replaced.

The positioning of the rear hook 42 and the front hooks 43 upon the lower surface of the shelves 10 is illustrated in FIG. 11*a*. The rear hook 42 extends across a substantial portion of the rear of each shelf 10 and provides structural support thereto. Two separate front hooks 43 are used. One front hook 43 is disposed upon either side of the front lower surface of the planar member 74.

A wallcovering sample 68 is shown disposed upon a shelf 10 of FIG. 6. Wallcovering samples 68, such as wallpaper, are cut to approximately the same dimensions as the planar member 74 and disposed upon the shelf 10 with their decorative side upper-most such that it can be viewed by customers.

The wallcovering sample 68 may be viewed under various lighting conditions, such as by viewing it near an open window or under incandescent lights. The wallcovering sample may also be compared to items brought into the retail outlet by the customer. It is not intended that the sample wallcovering 68 generally be removed from the retail outlet by the customer. Smaller precut take-home samples are provided for this purpose in each pocket 24 located adjacent shelves 10.

Referring to FIGS. 7 and 8, mounting of the shelves 10 upon the posts 26 and 27 attached to end support columns 12 and 14 and intermediate support column 16 is illustrated. Each shelf 10 rests upon two rear posts 26 and two front posts 27. One front post 27 and one rear post 26 is attached to a first support column 12, 14, or 16 on each side of the shelf 10. The hook 42 located at the rear of each shelf 10 upon its lower surface engages the rear posts 26 and the hooks 43 located at the front of each shelf 10 engage the front posts 27. The hooks 42 and 43 thereby prevent the shelf 10 from sliding off of the posts 26 and 27. Each shelf 10 is inclined sufficiently to permit the viewing of the front portion of each wallcovering sample.

Each shelf 10 may be removed from the wallcovering rack by sliding the shelf inward approximately one inch and then raising the shelf slightly to permit its withdrawal without re-engaging the hooks 42 and 43 with a post 26 or 27. Each shelf 10 is installed by simply sliding the shelf 10 in over the posts 26 and 27 upon which it will rest, while simultaneously raising the hooks 42 and 43. Raising the shelf 10 allows it to ride over the posts 26 and 27. The shelf 10 is then lowered and slid forward to permit the hooks 42 and 43 to engage the posts 26 and 27.

Referring now to FIG. 9, the fluorescent fixture 64 and fluorescent light 66 are depicted as they are disposed within an intermediate support column 16. The fluorescent light 66 extends to a distance slightly above the uppermost end of light opening 20. This assures even illumination of the light opening 20.

Referring now to FIG. 10, the attachment of the long horizontal member 28 to the end support column 12 is shown. Suitable fasteners, such as screws 38, are used to secure the long horizontal member 28 to the end support column 12. The long horizontal member 28 is disposed within a recess 49 formed in inside panel 48. This assures a more secure engagement of the long horizontal member 28 and the inside panel 48. Additional fasteners (not shown) may be used to secure the long horizontal member 28 to the outside panel 50.

Hook and looP fasteners may be used to conveniently attach sections of the wallcovering display rack together. For example, the first 12 and second 14 end support columns and the intermediate support columns 16 could be attached to the bases 18 with hook and loop fasteners.

A connecting member 44, shown in phantom in FIG. 10, may be used to connect two Wallcovering racks back-to-back, as shown in FIG. 1. Suitable fasteners, such as wood screws, secure the connecting member 44 to the end support columns 12 and 14. The semi-circular base 46 of FIG. 1 can also be used to further secure two wallcovering racks of the present invention together in a back-to-back fashion.

The wallcovering display rack of the present invention is best utilized by displaying wallcovering samples in a manner that facilitates the customer's rapid and simple location of the desired wallcovering. This can be accomplished by arranging the wallcovering samples in a logical order that is immediately apparent to the customer upon viewing the wallcovering display rack.

An example of such a logical order would be to arrange wallcovering samples such that each column or stack of shelves contains a particular type of wallcovering, e.g. floral, striped, or textured. Colors would then be arranged in order from top to bottom for each column. That is, reds could be disposed upper-most in each stack, followed by pinks, oranges, and yellows, and ending with blues and purples lower-most. Thus, a customer desiring a floral patterned wallcovering having a predominantly blue color would immediately recognize that floral wallcoverings are all disposed within a particular column and thus would visually search that column for the desired color. On noticing that the blue shades are disposed toward the lower-most portion of the column, the customer would then concentrate his efforts upon the lower-most portion of the column in which the floral wallcoverings are disposed.

Therefore, any wallcovering desired can be quickly and easily located by a customer with little or no assistance from sales personnel. The wallcovering storage rack of the present invention provides a convenient and space efficient means of storing and displaying wallcovering samples while reducing the amount of sales assistance required by the customer in selecting the desired wallcovering.

It is understood that the exemplary wallcovering display rack described herein and shown in the drawings represents only a preferred embodiment of the invention. Indeed, various modifications and additions may be made to such embodiment without departing from the spirit and scope of the invention. For example, other types of construction and materials may be used. Molded plastic, foam core, and sheet metal construction is contemplated. Also, light sources other than fluorescent lights may be utilized Thus, these and other modifications and additions may be obvious to those skilled in the art and may be implemented to adapt the present invention for use in a variety of different applications.

What is claimed is:

1. A modular rack for displaying wallcovering samples, the rack comprising:

(a) a plurality of vertically stacked shelves, said shelves being inclined such that the front of a shelf is lower than the rear of the same shelf to provide a visual display of wallcovering samples disposed upon the shelves;

(b) at least one vertical support member disposed adjacent said shelves, to which said shelves are attachable;

(c) a plurality of pockets disposed upon said vertical support columns, said pockets being disposed generally adjacent said shelves, the number of pockets substantially conforming to the number of shelves;

(d) a light source disposed within at least one of the vertical support members to illuminate the wallcoverings disposed upon said shelves; and (e) wherein the shelves and the vertical support member define a modular unit which is attachable to other similar modular units.

2. The modular rack as recited in claim 1 wherein the light source comprises a fluorescent light vertically disposed within said vertical support column.

3. The modular rack as recited in claim 2 further comprising a filter disposed adjacent the upper-most portion of said fluorescent light for reducing the intensity of light from said fluorescent light incident upon the upper-most shelf.

4. The modular rack as recited in claim 2 wherein the vertical distance between said shelves is between one and four inches.

5. The modular rack as recited in claim 4 wherein said shelves disposed lower-most in a stack are inclined less than said shelves disposed upper-most in a stack.

6. The modular rack as recited in claim 5 wherein said shelves further comprise:

(a) a stop for engaging a displayed wallcovering to prevent the wallcovering from sliding off said shelf; and (b) at least one hook formed upon the lower surface of said shelf for securing said shelf to said vertical support member.

7. The modular rack as recited in claim 6 wherein at least one of said hooks formed upon the lower surface of said shelf extend substantially across said shelf to provide structural support thereto.

8. A method for displaying wallcovering samples comprising the steps of:

(a) supporting a vertical stack of inclined shelves with a vertical support member;

(b) disposing wallcovering portions upon the vertically stacked shelves;

(c) disposing a plurality of wallcovering take-home samples within pockets, the pockets being disposed generally adjacent the shelves, the wallcovering take-home samples being removable from the pockets;

(d) illuminating the shelves from a light source disposed within the vertical support member; and (e) wherein the shelves are vertically stacked such that the front of the shelves is lower than the rear of the shelves and provides a visual display of the wallcoverings disposed upon the shelves.

9. The method as recited in claim 8 further comprising the step of attaching a plurality of vertical stacks of shelves together to form a horizontal series of stacked shelves.

10. The method as recited in claim 9 wherein the step of supporting a vertical stack of inclined shelves further comprises supporting a vertical stack of inclined shelves such that the lower-most shelves are less inclined than the upper-most shelves to facilitate the viewing of wallcovering samples disposed upon the lower-most shelves.

11. A modular rack for displaying wallcovering samples, the rack comprising:

(a) a plurality of modular units attached together, each modular unit comprising:

(i) a plurality of vertically stacked shelves, said shelves being inclined such that the front of a shelf is lower than the rear of the same shelf to provide a visual display of wallcovering samples disposed upon the shelves;

(ii) at least one vertical support member disposed adjacent said shelves, to which said shelves are attachable;

(iii) a light source disposed within at least one of the vertical support members to illuminate the wallcoverings disposed upon said shelves; and (b) at least one base trim member, each of said base trim members extending along a plurality of said modular units to attach said modular units together and to enhance the aesthetic appeal of the rack.

12. The modular rack as recited in claim 11, further comprising:

(a) at least one base member attached to the base of the two of said racks, said at least one base member attaching said racks back-to-back and further enhancing the aesthetic appeal of the racks; and (b) at least one connecting member attached to the tops of said racks, said at least one connecting member attaching said racks back-to-back.

* * * * *